United States Patent [19]

Flaherty, Jr.

[11] Patent Number: 4,635,942

[45] Date of Patent: Jan. 13, 1987

[54] RING-A-DING HOOK GAME

[76] Inventor: John J. Flaherty, Jr., 106 Elm St., Hyannis, Mass. 02601

[21] Appl. No.: 818,262

[22] Filed: Jan. 13, 1986

[51] Int. Cl.[4] ..... A63B 67/06; A63B 67/10

[52] U.S. Cl. ..... 273/332; 273/319; 273/338; 273/377

[58] Field of Search ..... 273/332, 319, 336, 338, 273/371, 377, 1 GC, 1 E

[56] References Cited

U.S. PATENT DOCUMENTS

| | | | |
|---|---|---|---|
| 292,899 | 2/1884 | Davies | 273/332 |
| 2,148,346 | 2/1939 | Goldman | 273/339 |
| 2,942,886 | 6/1960 | Ackerman | 273/332 |
| 2,950,917 | 8/1960 | Lyon | 273/332 |
| 3,024,025 | 3/1962 | Richardson et al. | 273/319 |

FOREIGN PATENT DOCUMENTS

| | | | |
|---|---|---|---|
| 637944 | 3/1962 | Canada | 273/332 |
| 433409 | 10/1911 | France | 273/377 |
| 11193 | of 1908 | United Kingdom | 273/338 |

*Primary Examiner*—William H. Grieb

*Attorney, Agent, or Firm*—Herbert E. Messenger

[57] ABSTRACT

Disclosed is a ring and hook game played by swinging a metal ring attached to a flexible line towards a pair of hooks projecting from a box mounted on a wall. When the ring successfully engages the hooks the ring closes an electrical circuit, activating a light and buzzer connected in parallel within the box. Attachment of the flexible line to a ceiling permits automatic return of the ring after a missed attempt, and the location of the box and the point of attachment of the line, together with appropriate selection of line length, prevent the ring from striking the front wall of the box. The degree of difficulty of the game may easily be varied by rotation of one or both hooks.

14 Claims, 5 Drawing Figures

RING-A-DING HOOK GAME

BACKGROUND OF THE INVENTION

This invention relates to amusement devices and more particularly to a game of skill wherein a ring is directed towards a pair of hooks extending from a target.

Various games are known in which rings are thrown towards pegs or other projections with the object of engaging the ring over a target peg. For example, ring-toss games are common at carnivals and fairs.

U.S. Pat. No. 3,024,025 discloses a variation of the standard ring-toss game in which the nose of a translucent puppet head forms a target towards which a metal ring is thrown. Successful "ringing" of the nose completes an electric circuit in the puppet head, activating a light to "reward" the player. The patent describes two forms of electric circuits. In one the ring is tethered to the puppet head by a conductive wire and the puppet nose contains a single terminal arranged such that lodging of the ring thereon closes a circuit. In the second embodiment the puppet nose includes two spaced apart, parallel terminals which are both contacted to complete a circuit when an untethered ring is successfully tossed over the nose.

A more elaborate ring toss game is disclosed in U.S. Pat. No. 2,148,346, in which a board contains several illuminated targets each comprising a pair of L-shaped elements separated by a gap. Tossing of a hoop over a target completes an electrical circuit, causing an appropriate score to be registered on a scoreboard connected to each individual target.

While the above-described games have several desirable features, including testing the skill of players and providing a psychic reward to the successful participant, they also have drawbacks. One shortcoming of these prior art ring games is that they require a player or other person to retrieve rings which miss the target. Such rings will typically fall to the floor or, in the case of a ring tethered to the target, will hang suspended below the target. Also, when metal rings of the prior art games are tossed at targets, the rings will frequently strike the board or surface from which the targets project, and thus may damage or mar the appearance of the surface.

Accordingly, it is an object of the invention to provide an improved ring game.

It is an object of the invention to provide a ring game wherein a ring directed at a target returns automatically in the event of a miss.

It is also an object of the invention to provide a ring and hook game whose degree of difficulty may be quickly and easily varied.

It is a further object of the invention to provide a ring and hook game wherein a ring directed at a pair of hooks is prevented from contact with the surface from which the hooks project.

SUMMARY OF THE INVENTION

The invention is a ring game the object of whose play is to hook an electrically conductive ring onto two spaced-apart hooks projecting from a front wall of a housing such as a box. Within the box are a light source, a buzzer, and a power source such as a battery, forming an electrical circuit except for the gap between the hooks. During play the box is preferably mounted on a vertical wall, and the ring is suspended by a flexible line from a ceiling at a point several feet in front of the box. A player swings the ring in an arc towards the hooks in an attempt to engage the hooks. If the ring passes over and is retained by the hooks, the ring bridges the gap. This completes the electrical circuit, activating the buzzer and the light, and the light is visible through an opening in the front of the box. If the ring misses being hooked, it automatically swings back in pendulum fashion and returns nearly to the same point from which it was directed so that a player may catch the ring and either try again or give another player a turn at the game.

In a preferred embodiment the two hooks of the game have generally upwardly extending portions at their outer ends and are rotatable in the openings of the box through which they project. This permits the gap between the end portions to be easily varied to increase or decrease the difficulty of ringing the hooks. Also, the length of the flexible line or string and the distance between its point of attachment and the box are set such that the ring, when swung, may reach over the hooks but will not extend far enough to contact the box. In this way damage to the front wall of the box by the ring is avoided.

DETAILED DESCRIPTION OF PREFERRED EMBODIMENTS

Figure 1:
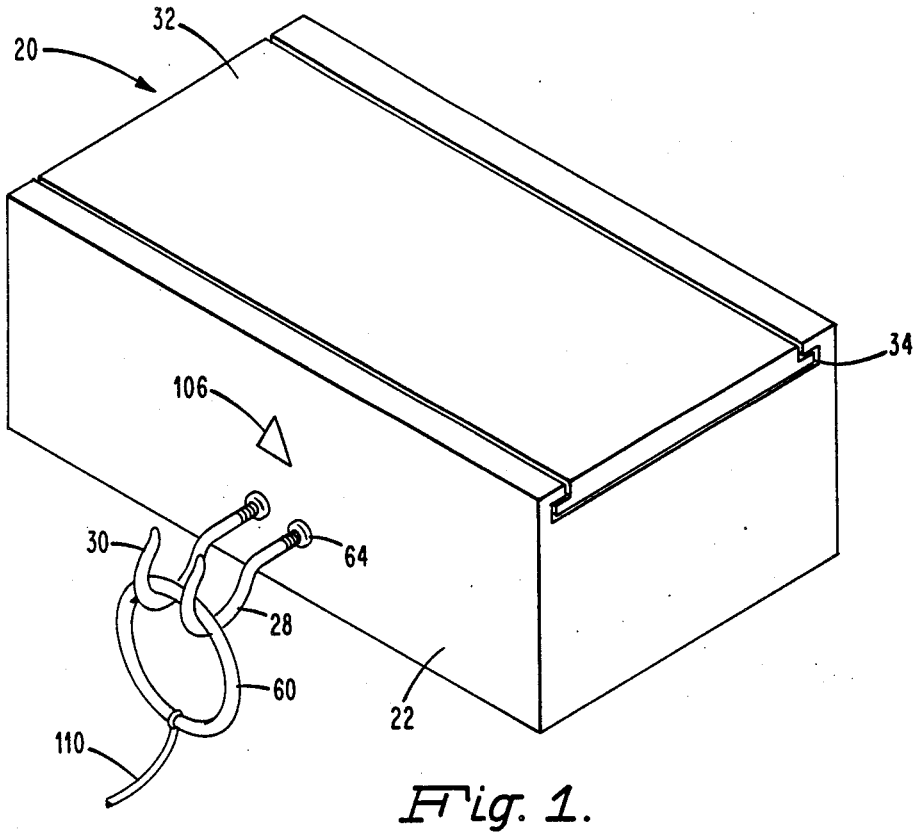
FIG. 1 is a perspective view of a preferred embodiment of the game of the invention, showing a ring in a position where it is held by hooks and bridges the gap between the hooks.

The ring and hook game of the invention, as illustrated in FIGS. 1–5, includes a housing, preferably a box 20, from whose front wall 22 project a pair of metal hooks 28 and 30. The top 32 of the box 20 is removable—for example, by means of grooves 34 (FIG. 1) along which the top 32 may be slid—to permit access to the interior of the box 20.

Figure 3:
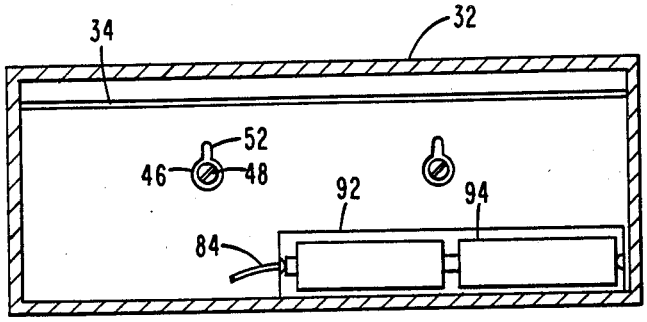
FIG. 3 is a cross-sectional view taken along the line 3—3 of FIG. 2 showing a preferred mounting arrangement for the box.

As indicated in FIG. 3, a pair of holes 40 are provided in the rear wall 42 of the box for mounting of the box 20 on a vertical surface such as a wall of a room. The holes 40 preferably are elongated, with a lower circular portion 46 of size greater than the diameter of the head of attachment screws 48 and an upper portion 52 of smaller size. Once the screws 48 have been threaded part way into a wall, the elongated holes 40 permit the box 20 to be easily hung on, and removed from, the screws 48.

Figure 4:
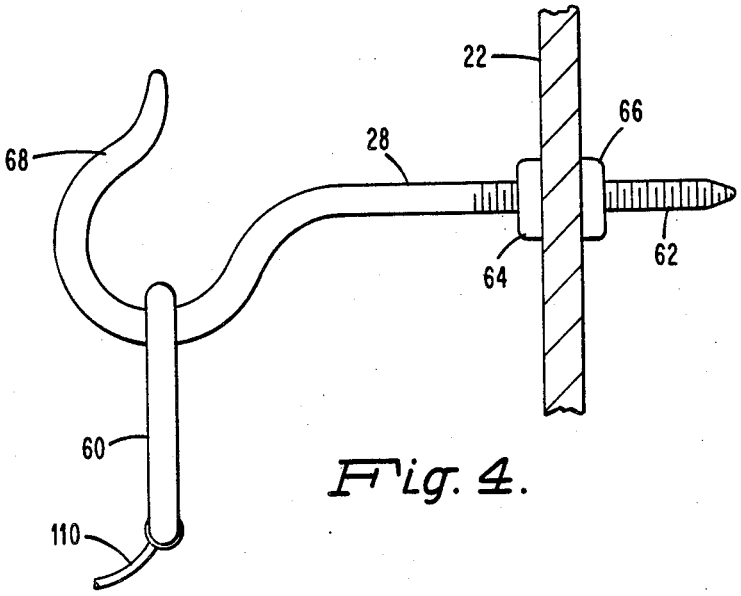
FIG. 4 is a cross-sectional view taken along the line 4—4 of FIG. 2 and enlarged to more clearly show the details of a preferred hook.

The hooks 28 and 30 which form the target to be hooked by a ring 60 preferably include a screw-like end portion 62 which is threaded through holes 64 in the front wall 22 of the box 20 and is secured by fasteners 66 (FIG. 4). The fasteners 66 may be rubberized faucet washers which hold the hooks 28 and 30 tightly in place but permit the hooks to be rotated by grasping the curved ends 68. Rotation of either or both hooks 28 and 30 in a direction towards the other decreases the gap 70 between the curved ends 68, reducing the difficulty of looping the ring 60 onto the hooks. Conversely, rotation of one or both hooks 28 and 30 away from the other increases the gap 70, raising the degree of difficulty of successfully hooking the ring 60. Factors limiting such rotation, however, are the need to avoid contact between any portion of the hooks so as to prevent closing of the electrical circuit to be described hereinafter and to maintain a gap 70 sufficiently small to permit the ring 60 to pass over the hooks 28 and 30.

Figure 2:
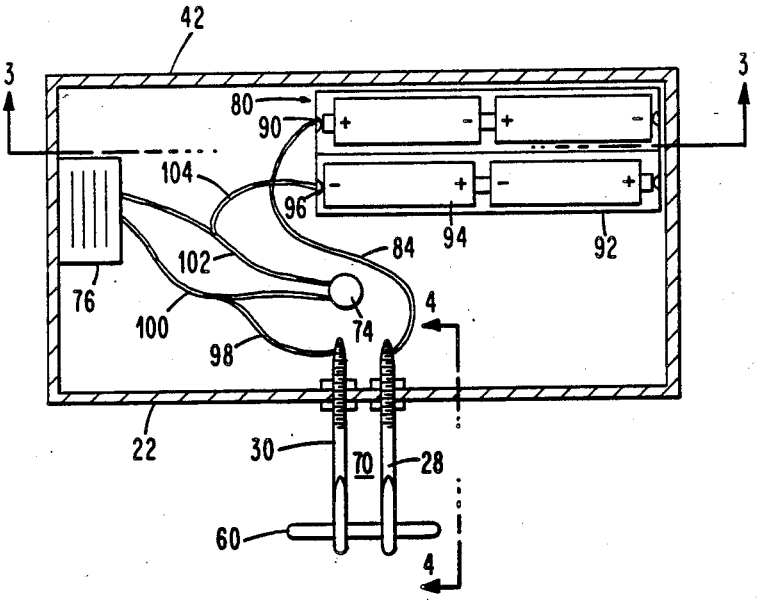
FIG. 2 is a top view of the box of FIG. 1 showing components within the box and their electrical connections.

In order to provide a positive indication to a player that the ring 60 has engaged the hooks 28 and 30, the game has within the box 20 a light 74 and a noise source 76 such as a buzzer which are activated by an electrical power source 80 when the metal ring 60 completes an electrical circuit by bridging the gap 70 between the hooks 28 and 30. As shown in FIG. 2, an electrical wire 84 connects the end portions 62 of one of the hooks 28 to a positive terminal of a battery holder 92 containing for 1.5 volt C cell batteries connected in series. The light 74 and a buzzer 76 are electrically connected in parallel between the hook 30 and a negative terminal of the battery holder 92 by wires 98, 100, 102, and 104. A hole 106 in the front wall 22 of the box 20 permits radiation from the light 74 to be readily seen and sound from the buzzer 76 to be heard when these elements are activated. The parallel arrangement of the buzzer 76 and the light 74 (which may be flashlight bulb) assures a positive indication that the ring 60 has engaged the hooks 28 and 30 even if either the light 74 or buzzer 76 fails.

Figure 5:
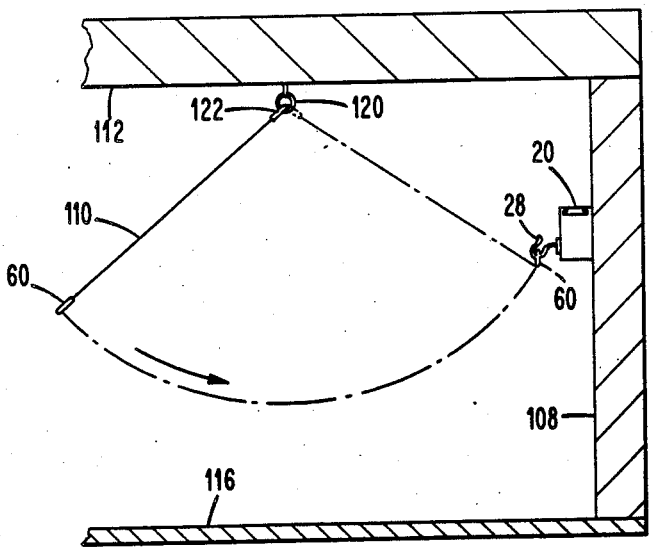
FIG. 5 is a view of the game set up for play, with the box mounted on a vertical wall and the ring attached to a flexible line suspended from a ceiling.

FIG. 5 illustrates the remaining components of the game and their location relative to the box 20, with the game set up for play. Although the game as described to this point could be played by merely tossing an untethered ring towards the hooks 28 and 30 with the box 20 mounted on a wall 108, it is an essential aspect of the present invention that the ring 60 be tied to one end of a flexible line 110 whose other end is attached to a ceiling 112 at a point 114 several feet in front of the box 20. This permits the ring 60 to be swung in an arc towards the hooks 28 and 30 and, in the event that the ring 60 is not successfully hooked, it swings back towards the player and may readily be caught for repeated tries at engaging the hooks. Also, it is preferred that the attachment point 114 and the length of the line 110 be selected such that the ring 60 may readily reach and loop over the hooks 28 and 30 but may not extend far enough to contact the front wall 22 of the box 20. Because the ring cannot strike the front wall 22, the surface of the wall 22 is not scuffed or marred and possible damage to electrical components within the box 20 is avoided.

A preferred mounting arrangement for the game is shown in FIG. 5. The box 20 is hung on a wall 108 about five feet up from the floor 116 of a room by screws 48 (FIG. 3) extending through the rear wall 42 of the box 20 and partially threaded into the wall 108 or into appropriate anchors (not shown) inserted into the wall 108 to retain the screws 48. A screw eye 120 is threaded into the ceiling 112 at a distance of about four to five feet from the wall 108 and directly in line with the centerline between the hooks 28 and 30 projecting from the box 20. Next one end of a flexible line 110, preferably a non-conductive string such as monofilament fishing line, is tied to a snap swivel 122 and the snap swivel 122 is connected to the screw eye 120. The opposite end of the line 110 is tied to the ring 60 at a point selected so as to permit the ring 60 to reach over and engage the hooks 28 and 30 but not to extend far enough to contact the surface of the front wall 22. The game is now ready for play by a person positioned at or slightly behind the location of the ring 60 when suspended at rest from the ceiling 112. The player swings the ring 60 towards the hooks 28 and 30 and, if successful in hooking the ring 60, as indicated by activation of the light 74 and buzzer 76, is awarded a point.

While the invention has been shown and described with reference to a preferred embodiment, it is clear that changes may be made to the preferred game without departing from the essential spirit and nature of the invention. For example, a printed circuit may readily be used instead of the electrical wires disclosed herein. The scope of the invention is limited only by the claims which follow, and the invention is intended to cover all ring games and their equivalents which are within those claims.

What is claimed is:

1. A ring game comprising:

a housing forming a hollow enclosure, said housing having opposed front and rear walls;

a pair of electrically conductive hooks projecting outward from said front wall, said hooks being separated from each other by a gap;

an electrical light source and an electrical power source within said housing;

electrical means within said housing for connecting said light source and said electrical power source between said hooks, said electrical means forming with said light source and said electrical power source a circuit when said gap is electrically bridged, whereby said light source is activated;

an opening in said front wall through which light emanates upon activation of said light source;

an electrically conductive ring engageable on said hooks so as to bridge said gap;

means for mounting said housing on a generally vertical surface;

a flexible line having a first end attachable to said ring and a second end suspendible from a horizontal surface a selected distance above and in front of the position of mounting of said housing on said generally vertical surface, whereby said ring may be propelled in an arc towards said hooks to either become engaged on said hooks, or will, in the event said ring fails to engage said hooks, tend to return to the general area from which said ring was propelled.

2. A ring game as in claim 1 further including an electrical noise source connected in parallel with said light source.

3. A ring game as in claim 1 wherein said flexible line is a non-conductive plastic line.

4. A ring game as in claim 1 wherein said electrical power source comprises at least one dry cell battery.

5. A ring game as in claim 1 including a screw eye attachable to said horizontal surface and a swivel snappable onto said screw eye, and wherein said second end of the line may be tied to said swivel.

6. A ring game as in claim 1 wherein said line, when attached to said ring, and suspended from said horizontal surface, has a length such said ring may be swung toward said housing a maximum distance sufficient to engage said hooks but not sufficient to contact the front wall of the housing.

7. A ring game as in claim 1 wherein said housing comprises a box of rectangular cross-section and said box includes a removable top.

8. A ring game as in claim 7 wherein a pair of openings are formed in said rear wall of said box and said means for mounting the box on a generally vertical surface includes a pair of screws which may be partially threaded into holes in a wall containing said vertical surface.

9. A ring game as in claim 8 wherein each of said openings is shaped to include a lower portion of diameter greater than the diameter of the head of said screw, and an upper portion of diameter smaller than the diameter of said head and larger than the diameter of the shank of said screw, whereby, following partial threading of said screws into the wall, said box may be releasably supported from said screws.

10. A ring game as in claim 1 wherein the end portions of said hooks away from said front wall are bent to extend in a generally vertically upward direction.

11. A ring game as in claim 10 wherein at least one of said hooks is rotatable relative to said front wall to change the gap between the upwardly extending end portions of said hooks and thereby to vary the degree of difficulty of engaging said ring on the hooks.

12. A ring game as in claim 1 wherein said hooks are each shaped to include a recessed, partially circular portion to retain said ring.

13. A ring game comprising:

a box having a front wall, a rear wall, a pair of side walls, and top and bottom walls;

means for mounting said box on a vertical wall of a room a selected distance below the ceiling of said room and with said hooks facing outward from said vertical wall;

a pair of metal hooks each extending through an opening in, and projecting outward from, said front wall, said hooks being separated from each other by a gap;

a light bulb, a buzzer, and at least one dry cell battery electrically connected between said hooks within said box to form an electrical circuit when said gap is bridged, said light bulb and buzzer connected in parallel;

a metal ring engageable on said hooks to bridge said gap and thereby cause said bulb to light and said buzzer to sound;

a hole in said front wall through which light is emitted upon lighting of said bulb;

a non-conductive, flexible line having a first end and a second end, said first end attachable to said ring; and means for attaching said second end of the flexible line to said ceiling at a point along an axis substantially perpendicular to said front wall of the box and equidistant from said hooks, the length of said line between its points of attachment being such that said ring, when propelled in an arc towards said hooks, will swing a maximum distance sufficient to engage said hooks but not sufficient to contact the front wall of the housing.

14. A ring game as in claim 13 wherein the outward end of each hook extends in a generally vertically upward direction, and at least one of said hooks is rotatable relative to said front wall to change the gap between said outward ends of the hooks and thereby to vary the degree of difficulty of engaging said ring on the hooks.

* * * * *